US009442406B2

(12) United States Patent
Watanabe et al.

(10) Patent No.: US 9,442,406 B2
(45) Date of Patent: Sep. 13, 2016

(54) IMAGE FORMING APPARATUS FOR DETERMINING A DIFFERENCE IN LIGHTNESS BETWEEN COLORS IN TONER IMAGE FORMING UNITS

(71) Applicant: FUJI XEROX CO., LTD., Tokyo (JP)

(72) Inventors: Sho Watanabe, Kanagawa (JP); Satoshi Shigezaki, Kanagawa (JP); Yoko Miyamoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/606,428

(22) Filed: Jan. 27, 2015

(65) Prior Publication Data

US 2016/0004180 A1 Jan. 7, 2016

(30) Foreign Application Priority Data

Jul. 7, 2014 (JP) ..... 2014-139815

(51) Int. Cl.
*G03G 15/01* (2006.01)
*G03G 15/16* (2006.01)
*G03G 15/00* (2006.01)

(52) U.S. Cl.
CPC ..... *G03G 15/0131* (2013.01); *G03G 15/1605* (2013.01); *G03G 15/5062* (2013.01); *G03G 15/6585* (2013.01)

(58) Field of Classification Search
CPC ..... G03G 15/0131; G03G 15/1605
See application file for complete search history.

(56) References Cited

U.S. PATENT DOCUMENTS

2003/0133719 A1* 7/2003 Tsuruya et al. ..... 399/12
2011/0008544 A1* 1/2011 Yashiki et al. ..... 427/378

FOREIGN PATENT DOCUMENTS

JP H08-146704 A 6/1996
JP H09-200551 A 7/1997
JP 2011-174970 A 9/2011

* cited by examiner

*Primary Examiner* — David Gray
*Assistant Examiner* — Laura Roth
(74) *Attorney, Agent, or Firm* — Oliff PLC

(57) ABSTRACT

An image forming apparatus includes a transfer member, first transfer units, and second transfer units. Images of reference colors and other colors are transferred onto the transfer member being rotated. The first transfer units each transfer the image of a corresponding one of the reference colors. The second transfer units disposed upstream of the first transfer units in a rotational direction of the transfer member each transfer the image of a corresponding one of the other colors. The image of one of the reference colors is transferred by one of the first transfer units disposed most upstream. The other colors include at least one color of lightness lower than lightness of the one of the reference colors of the image transferred by the one of the transfer units. The highest-lightness image among the other colors is transferred by one of the second transfer units disposed most downstream.

5 Claims, 11 Drawing Sheets

FIG. 8

| SPECIAL COLOR | DIFFERENCE IN LIGHTNESS BETWEEN SPECIAL COLOR AND YELLOW AS REFERENCE COLOR (POSITIVE IF LIGHTNESS IS LOWER THAN YELLOW AND NEGATIVE IF LIGHTNESS IS HIGHER THAN YELLOW) |
|---|---|
| VIOLET (V) | +59 |
| GREEN (G) | +27 |
| ORANGE (O) | +22 |
| CLEAR (W) | −2 |

IMAGE FORMING APPARATUS FOR DETERMINING A DIFFERENCE IN LIGHTNESS BETWEEN COLORS IN TONER IMAGE FORMING UNITS

CROSS-REFERENCE TO RELATED APPLICATIONS

This application is based on and claims priority under 35 USC 119 from Japanese Patent Application No. 2014-139815 filed Jul. 7, 2014.

BACKGROUND

Technical Field

The present invention relates to an image forming apparatus.

SUMMARY

An image forming apparatus according to an aspect of the present invention includes a transfer member, plural first transfer units, and plural second transfer units. Images of reference colors including yellow, magenta, cyan, and black and images of plural other colors are transferred onto the transfer member while the transfer member is being rotated. The plural first transfer units each transfer the image of a corresponding one of the reference colors. The plural second transfer units are disposed upstream of the first transfer units in a rotational direction of the transfer member and each transfer onto the transfer member the image of a corresponding one of the plural other colors different from the reference colors. In the image forming apparatus, the image of one of the reference colors other than black is transferred by one of the plural first transfer units disposed most upstream in the rotational direction, the plural other colors include at least one color of lightness lower than lightness of the one of the reference colors of the image transferred by the one of the plural first transfer units disposed most upstream in the rotational direction, and one of the images which is of a highest lightness color among the plural other colors is transferred by one of the plural second transfer units disposed most downstream in the rotational direction.

BRIEF DESCRIPTION OF THE DRAWINGS

Exemplary embodiments of the present invention will be described in detail based on the following figures, wherein:

FIG. 8 illustrates a table listing the differences in lightness between yellow and special colors and the like used in the image forming apparatus according to the first exemplary embodiment of the present invention;

DETAILED DESCRIPTION

Figure 1:
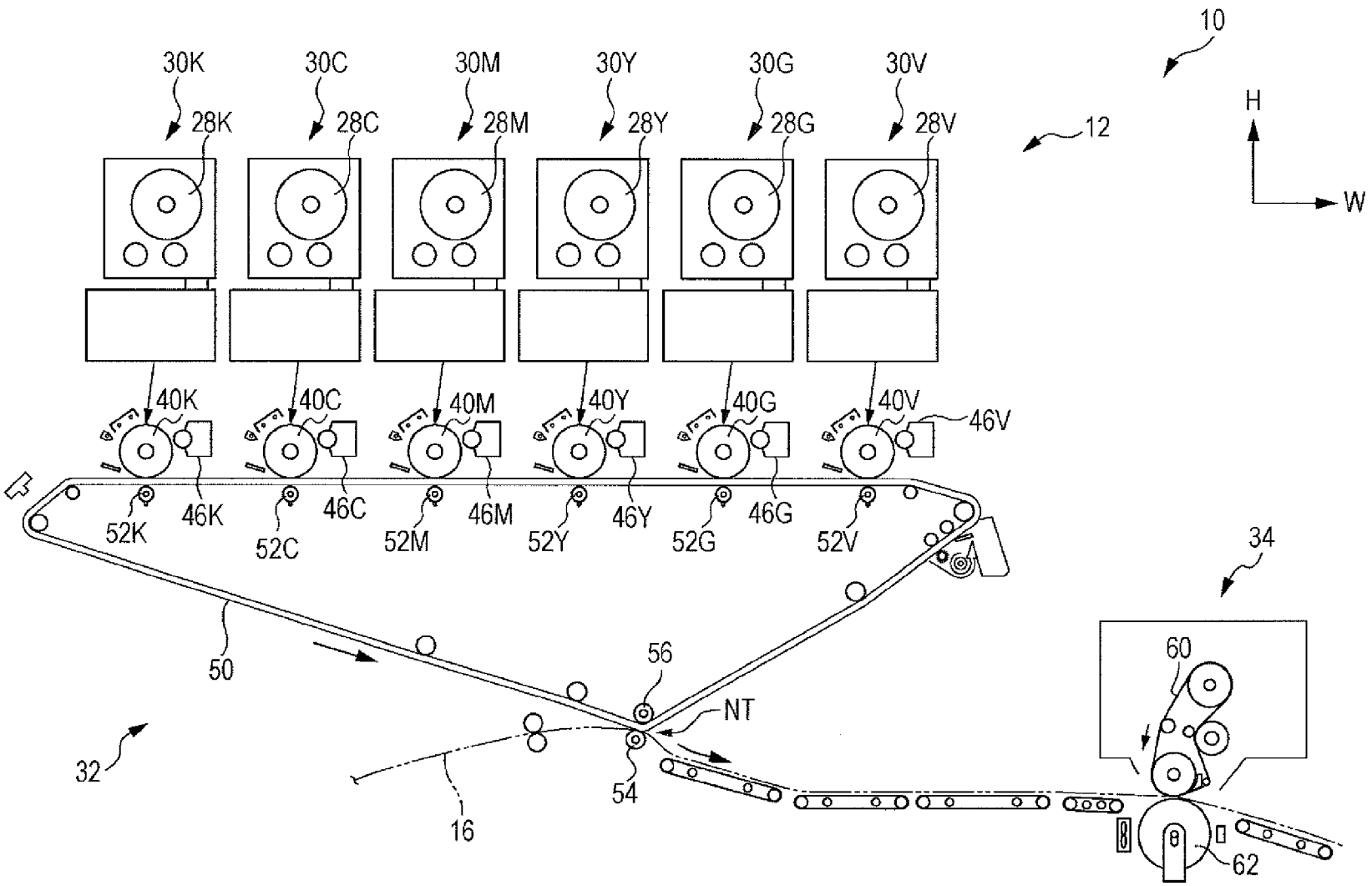
FIG. 1 is a view illustrating a structure of a transfer device and so forth of an image forming apparatus according to a first exemplary embodiment of the present invention.

An example of an image forming apparatus according to a first exemplary embodiment of the present invention will be described below with reference to FIGS. 1 to 10. In the drawings, an arrow H indicates the vertical direction, which is an up-down direction of the apparatus, and an arrow w indicates the horizontal direction, which is a width direction of the apparatus.

Overall Structure of the Image Forming Apparatus

Figure 10:
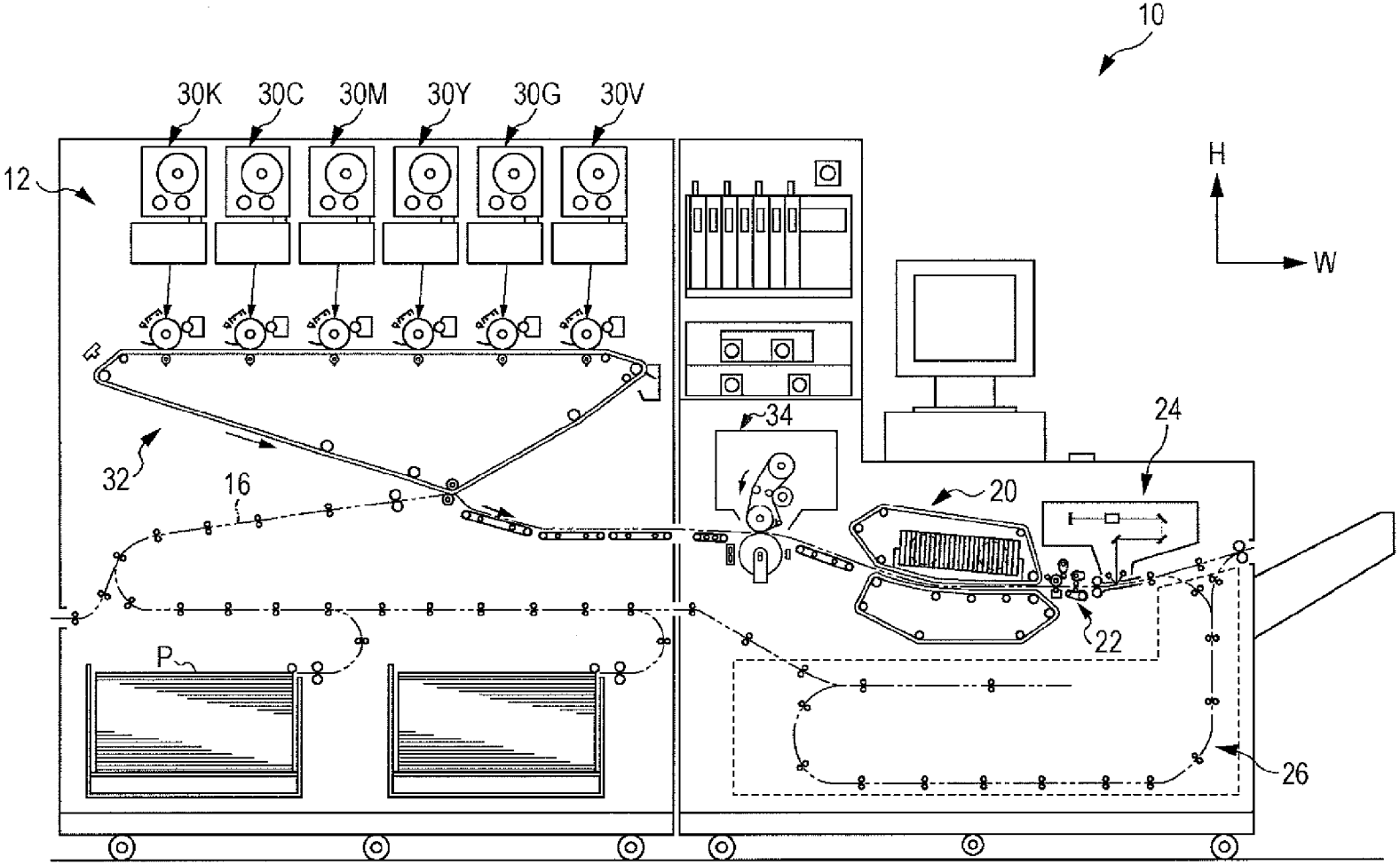
FIG. 10 is a view illustrating a structure of the image forming apparatus according to the first exemplary embodiment of the present invention.

As illustrated in FIG. 10, an image forming apparatus 10 includes an image forming section 12 and plural transport members (not denoted by reference signs). The image forming section 12 forms an image with an electrophotographic method. The transport members transport a sheet member P (an example of a recording medium) on which an image or images are formed along a transport path 16 of the sheet member P.

The image forming apparatus 10 also includes a cooling unit 20, a correction unit 22, and an image inspection unit 24. The cooling unit 20 cools the sheet member P on which an image or images have been formed. The correction unit 22 corrects bending of the sheet member P. The image inspection unit 24 inspects the image or the images formed on the sheet member P.

Furthermore, the image forming apparatus 10 includes an inversion path 26. The sheet member P having an image formed on a front side thereof is inverted and transported to the image forming section 12 again through the inversion path 26 for image formation on both the sides of the sheet member P.

With the image forming apparatus 10 having the above-described structure, an image (toner images) formed by the image forming section 12 is formed on the front side of the sheet member P being transported along the transport path 16. Furthermore, the sheet member P having the image formed thereon sequentially passes through the cooling unit 20, the correction unit 22, and the image inspection unit 24 in this order and is ejected to the outside of the apparatus.

When an image is formed on the back side of the sheet member P, the sheet member P having the image formed on the front side thereof is transported along the inversion path 26 so that an image is formed again on the back side of the sheet member P by the image forming section 12.

Configuration of the Elements

As illustrated in FIG. 1, the image forming section 12 includes plural toner image forming units 30 and a transfer device 32. The toner image forming units 30 each form a toner image of a corresponding one of colors. The transfer device 32 transfers the toner images formed by the toner image forming units 30 onto the sheet member P. The image forming section 12 also includes a fixing device 34. The fixing device 34 fixes onto the sheet member P the toner images which have been transferred onto the sheet member P by the transfer device 32.

The plural toner image forming units 30 are provided so that each of the toner image forming units 30 forms a toner image of a corresponding one of colors. In the present exemplary embodiment, the toner image forming units 30 of the following six colors are provided: violet (V), green (G), yellow (Y), magenta (M), cyan (C), and black (K). Signs "V", "G", "Y", "M", "C", and "K" illustrated in, for example, FIG. 1 represent the above-described colors.

Four colors, that is, yellow (Y), magenta (M), cyan (C), and black (K) are reference colors for outputting a color image. Violet (V) and green (G), which are different from the reference colors, are colors for increasing the color gamut of an output image ("special colors" hereafter).

In the following description, when it is not necessary that violet (V), green (G), yellow (Y), magenta (M), cyan (C), and black (K) be distinguished from one another, V, G, Y, M, C, and K are not included in the signs hereafter.

Figure 9:
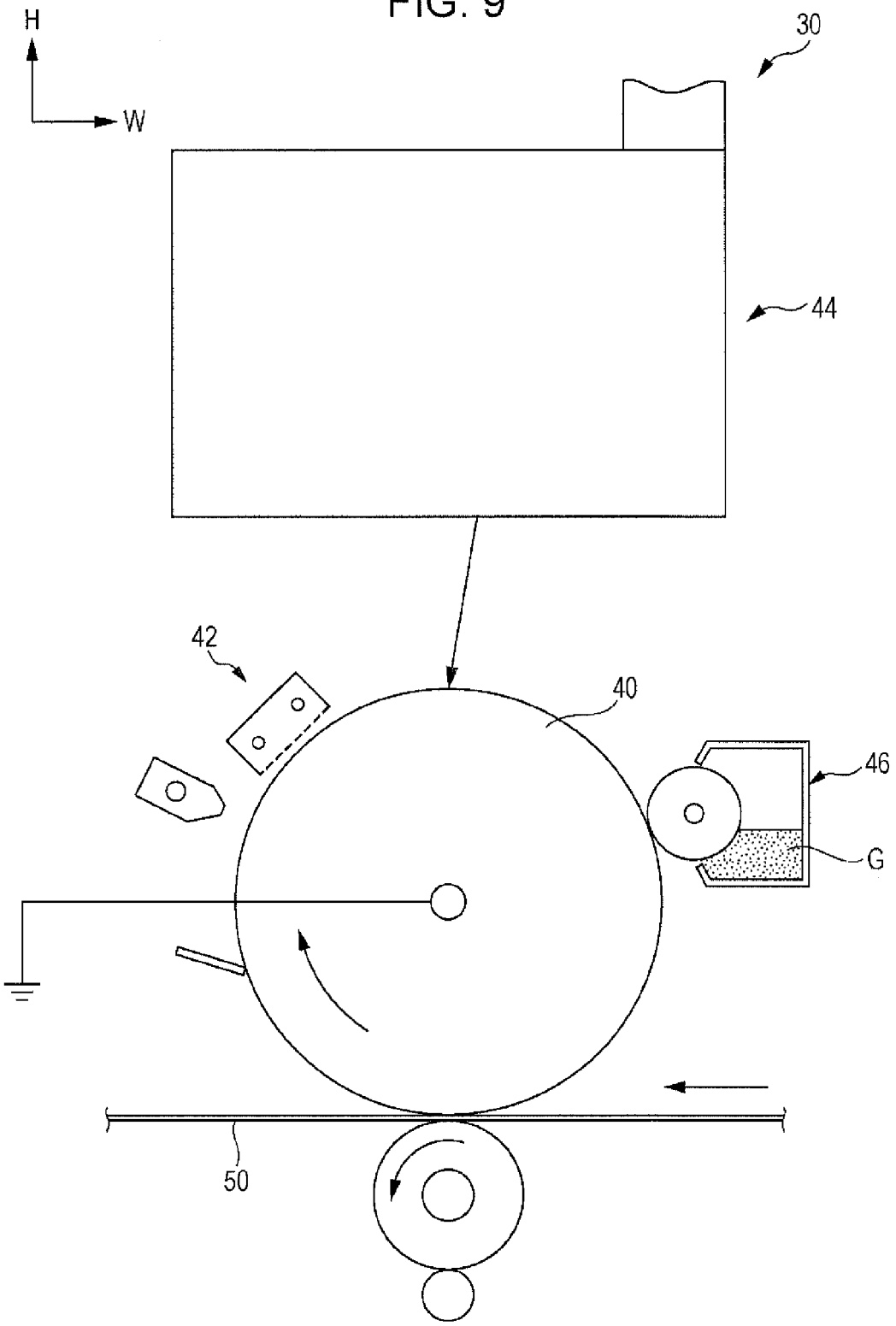
FIG. 9 is a view illustrating a structure of one of toner image forming units of the image forming apparatus according to the first exemplary embodiment of the present invention.

The toner image forming units 30 of the respective colors basically have structures similar to or the same as one another except for toner particles used therein. The toner image forming units 30 each include, as illustrated in FIG. 9, a cylindrical image holding member 40 that is rotated and a charger 42 that charges the image holding member 40. Furthermore, each of the toner image forming units 30 includes an exposure device 44 and a developing device 46. The exposure device 44 radiates exposure light toward the charged image holding member 40 so as to form an electrostatic latent image. The developing device 46 develops the electrostatic latent image into a toner image with developer G including toner particles.

Furthermore, as illustrated in FIG. 1, the toner image forming units 30 include toner cartridges 28 of the respective colors. The toner cartridges 28 are connected to the developing devices 46 of the respective colors through supply pipes (not illustrated) so as to supply the toner particles to the developing devices 46.

The image holding members 40 of the respective colors are in contact with a transfer belt 50 that is moved in a circumferential path (the details of the transfer belt 50 will be described later). The toner image forming units 30 of violet (V), green (G), yellow (Y), magenta (M), cyan (C), and black (K) are horizontally arranged side by side in this order from an upstream side in a rotational direction (see an arrow in FIG. 1) of the transfer belt 50. The toner image forming units 30 of the colors each use toner particles of a corresponding one of the colors to form an image of the corresponding color.

The transfer device 32 includes the transfer belt 50 that is in contact with the image holding members 40 of the colors so as to transfer toner images formed on the image holding members 40 of the colors onto the sheet member P. The details of the toner cartridges 28 and the transfer device 32 will be described later.

The fixing device 34 includes a fixing belt 60 and a pressure roller 62. The fixing belt 60 is looped over plural rollers (not denoted by reference signs) and heated. The pressure roller 62 applies pressure to the sheet member P in a direction toward the fixing belt 60.

With this structure, the sheet member P having toner images transferred thereonto is pinched between the fixing belt 60 being rotated and the pressure roller 62, thereby the toner images are fixed onto the sheet member P.

Toner Cartridges

The toner cartridges 28, which contain the toner particles therein, are detachably attached to an apparatus body. A chip (not illustrated) is attached to each of the toner cartridges 28. Information about a color, lightness, and so forth of the toner particles contained in the corresponding toner cartridge 28 has been input to the chip.

Transfer Unit

As illustrated in FIG. 1, the transfer device 32 includes the transfer belt 50 (an example of a transfer member) and first transfer rollers 52. The transfer belt 50 is looped over plural rollers (not denoted by reference signs) and rotated in the arrow direction illustrated in FIG. 1. The first transfer rollers 52 are each provided for a corresponding one of the colors and transfer a toner image formed on the image holding member 40 of the corresponding color onto the transfer belt 50.

Each of the first transfer rollers 52 is disposed on a side opposite to a corresponding one of the image holding members 40 with the transfer belt 50 interposed therebetween. A transfer bias voltage (positive voltage), the polarity of which is opposite to a toner polarity (negative polarity as an example in the present exemplary embodiment), is applied to each of the first transfer rollers 52 by a power supply unit (not illustrated). By applying this transfer bias voltage, a transfer current is caused to flow between the first transfer roller 52 and a corresponding one of the image holding members 40, thereby the toner image formed on the image holding member 40 is transferred onto the transfer belt 50.

The first transfer rollers 52Y, 52M, 52C, and 52K, which transfer the toner images of the respective reference colors yellow (Y), magenta (M), cyan (C), and black (K) onto the transfer belt 50 with the transfer currents as described above, each serve as an example of a first transfer unit. The first transfer rollers 52V and 52G, which respectively transfer the toner images of special colors violet (V) and green (G) onto the transfer belt 50 with the transfer currents, each serve as an example of a second transfer unit.

The transfer device 32 also includes a roller 56 and a second transfer roller 54. The transfer belt 50 is looped over the roller 56. The second transfer roller 54 is disposed on a side of the transfer belt 50 opposite to the roller 56 and causes the toner images having been transferred onto the transfer belt 50 to be transferred onto the sheet member P. Thus, a transfer nip NT that causes the toner images to be transferred onto the sheet member P is formed between the second transfer roller 54 and the transfer belt 50.

The transfer bias voltage (positive voltage), the polarity of which is opposite to the toner polarity, is applied to the second transfer roller 54 by the power supply unit (not illustrated). The transfer current is caused to flow between the second transfer roller 54 and the roller 56 by applying the transfer bias voltage. This causes the toner images to be transferred from the transfer belt 50 to the sheet member P passing through the transfer nip NT.

With this structure, the toner images of violet (V), green (G), yellow (Y), magenta (M), cyan (C), and black (K) are transferred in this order onto the transfer belt 50 by the first transfer rollers 52 through first transfer such that these toner images are superposed on one another. Furthermore, these superposed toner images are transferred onto the sheet member P passing through the transfer nip NT by the second transfer roller 54 through second transfer. The order of the superposed toner images is reversed in a state in which the toner images have been transferred on the sheet member P through second transfer, that is, toner images of black (K), cyan (C), magenta (M), yellow (Y), green (G), and violet (V) are transferred onto the sheet member P in this order.

Also in the image forming apparatus 10, the yellow (Y) (an example of a reference color of an image transferred by the first transfer unit disposed most upstream in the rotational direction) toner image is transferred onto the transfer belt 50 by the first transfer roller 52Y, which is disposed most upstream in the rotational direction of the transfer belt 50 among the first transfer rollers 52Y, 52M, 52C, 52K. The first transfer rollers 52V and 52G respectively transfer the violet (V) and green (G) toner images onto the transfer belt 50. Violet (V) and green (G) are low-lightness colors having lightnesses that are lower than that of yellow (Y), which is the reference color disposed on the most upstream side in the rotational direction among the reference colors.

A table in FIG. 8 illustrates the differences in lightness between yellow (Y) and the following colors: that is, violet (V), green (G), and orange (O), which may be used as special colors, and clear (W), which is transparent. When a value for a color is positive in the table, this represents that the lightness of this color is lower than that of yellow (Y); when a value for a color is negative in the table, this represents that the lightness of this color is higher than that of yellow (Y).

As illustrated in the table of FIG. 8, the lightnesses of violet (V), green (G), and orange (O) are lower than that of yellow (Y), and the lightness of clear (W) is higher than that of yellow (Y). Furthermore, among violet (V), green (G), and orange (O), the lightness of violet (V) is the lowest and the lightness of green (G) is next lowest to violet (V).

In the present exemplary embodiment, the first transfer roller 52V, which transfers the image of the color of the lowest lightness onto the transfer belt 50, is not disposed adjacent to the first transfer roller 52Y, which transfers the yellow (Y) toner image onto the transfer belt 50. In other words, the first transfer roller 52G, which transfers the image of the color of the highest lightness onto the transfer belt 50, is disposed adjacent to the first transfer roller 52Y, which transfers the yellow (Y) toner image onto the transfer belt 50. Specifically, the first transfer roller 52G is disposed adjacent to the first transfer roller 52Y, and the first transfer roller 52V is disposed adjacent to the first transfer roller 52G.

The lightness of each color is obtained by forming a single-color image patch having a 100% image coverage on the sheet member P and by measuring this single-color image patch with X-Rite 938 (manufactured by X-Rite, Inc.).

Toner Image Transferring Steps

Next, steps of transferring a toner image onto the sheet member P with an image forming apparatus 100 according to a comparative exemplary embodiment of the first exemplary embodiment and steps of transferring a toner image onto the sheet member P with the image forming apparatus 10 according to the first exemplary embodiment will be described with reference to FIGS. 2A to 7B. In these drawings, the image holding members 40, the transfer belt 50, and the first transfer rollers 52 are illustrated and the other components are omitted.

Comparative Exemplary Embodiment

Initially, the steps of transferring a toner image onto the sheet member P with the image forming apparatus 100 according to the comparative exemplary embodiment are described with reference to FIGS. 6A to 7B.

In the image forming apparatus 100 according to the comparative exemplary embodiment, the positional relationship between the toner image forming unit 30V and the toner image forming unit 30G is inverted compared to that in the image forming apparatus 10 according to the first exemplary embodiment. That is, the first transfer roller 52V is disposed adjacent to the first transfer roller 52Y. Furthermore, toner images are formed only by the toner image forming units 30Y and 30V of the image forming apparatus 100, and the toner images to be transferred onto the sheet member P are the toner image formed by the toner image forming unit 30V and the toner image formed by the toner image forming unit 30Y which is superposed on part of the toner image formed by the toner image forming unit 30V.

Figure 6A:
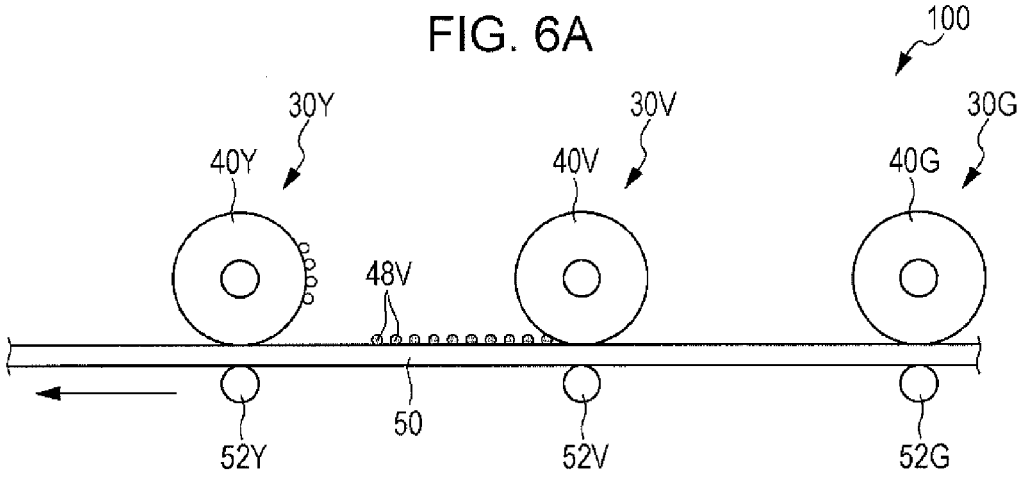
FIGS. 6A and 6B illustrate steps in which toner images are transferred onto the sheet member with an image forming apparatus according to a comparative exemplary embodiment of the first exemplary embodiment of the present invention.
Figure 6B:
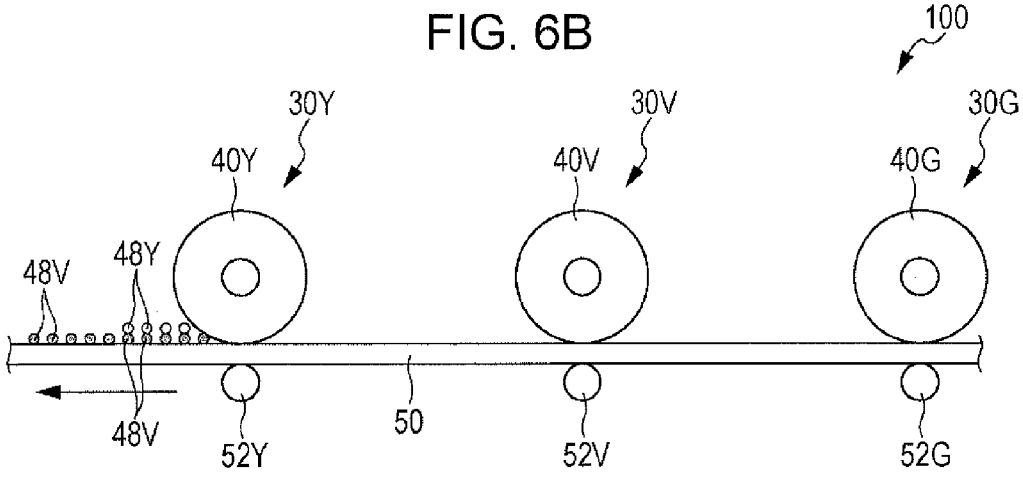

As illustrated in FIG. 6A, the toner image formed of negatively charged violet (V) toner particles 48V is transferred onto the transfer belt 50 by the transfer current flowing from the first transfer roller 52V toward the image holding member 40V. Furthermore, the toner image formed of the toner particles 48V is transported by the transfer belt 50 being rotated. Then, as illustrated in FIG. 6B, the toner image formed of negatively charged yellow (Y) toner particles 48Y is transferred by the transfer current flowing from the first transfer roller 52Y toward the image holding member 40Y such that the toner image formed of the toner particles 48Y is superposed on part of the toner image formed of the violet (V) toner particles 48V. Thus, there are the violet (V) toner particles 48V on which the yellow (Y) toner particles 48Y are not superposed and the violet (V) toner particles 48V on which the yellow (Y) toner particles 48Y are superposed on the transfer belt 50.

In this state, when the violet (V) toner image passes through the nip between the first transfer roller 52Y and the image holding member 40Y, an increase in the charge amount of the toner particles 48V on which the toner particles 48Y are not superposed is larger than an increase in the charge amount of the toner particles 48V on which the toner particles 48Y are superposed.

Figure 7A:
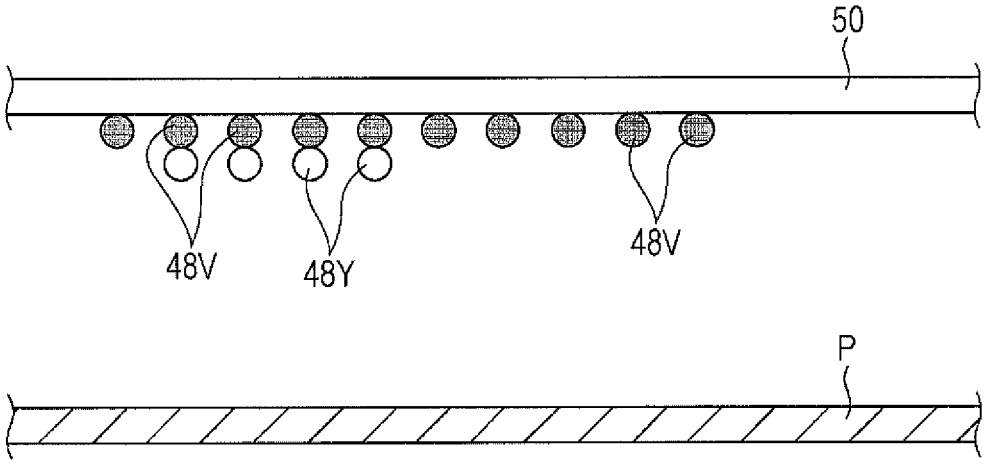
FIGS. 7A and 7B illustrate steps in which the toner images are transferred onto the sheet member with the image forming apparatus according to a comparative exemplary embodiment of the first exemplary embodiment of the present invention.
Figure 7B:
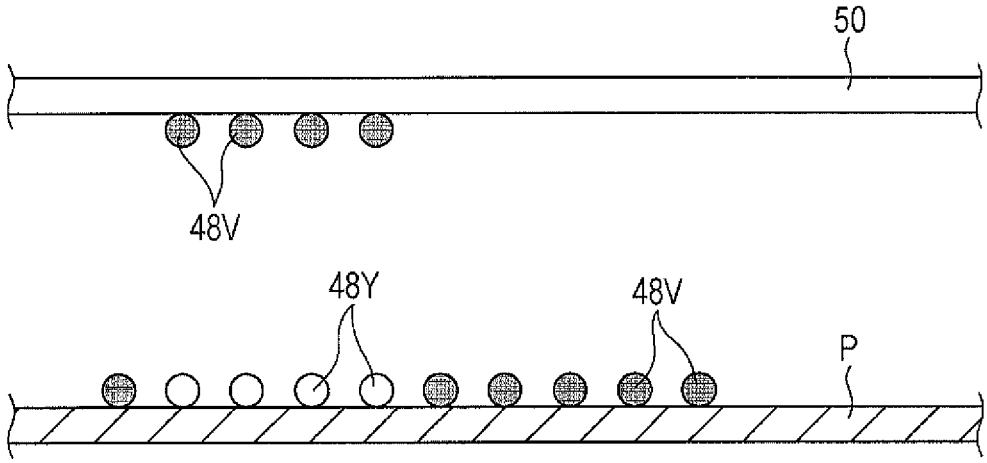

As illustrated in FIGS. 7A and 7B, by the transfer current flowing from the second transfer roller 54 toward the roller 56, the toner images formed of the toner particles 48Y and the toner particles 48V on the transfer belt 50 are transferred onto the sheet member P being transported.

It is noted that FIG. 7A illustrates a state before the toner images are transferred onto the sheet member P, and FIG. 7B illustrates a state after the toner images have been transferred onto the sheet member P. Furthermore, the elements are schematically illustrated in FIGS. 7A and 7B so that the toner particles having been transferred onto the transfer belt 50, the toner particles remaining on the transfer belt 50, and the toner particles having been transferred onto the sheet member P are easily recognized.

Here, the toner particles 48Y are interposed between the sheet member P and the toner particles 48V on which the toner particles 48Y are superposed. Furthermore, the charge amount of the toner particles 48V on which the toner particles 48Y are superposed is smaller than that of the toner particles 48V on which the toner particles 48Y are not superposed. Thus, as illustrated in FIG. 7B, the toner particles 48V on which the toner particles 48Y are superposed remain on the transfer belt 50 instead of being transferred onto the sheet member P.

This may cause unevenness in an output image. Furthermore, since the lightness of violet (V) is the lowest with respect to the yellow (Y), such unevenness may be clearly visible.

First Example of the First Exemplary Embodiment

Next, the steps of transferring a toner image onto the sheet member P with the image forming apparatus 10 according to a first example of the first exemplary embodiment are described with reference to FIGS. 2A to 3B.

As has been described, in the image forming apparatus 10 according to the first exemplary embodiment, the first transfer roller 52G is disposed adjacent to the first transfer roller 52Y, and the first transfer roller 52V is disposed adjacent to the first transfer roller 52G. Furthermore, toner images are formed only by the toner image forming units 30Y and 30V of the image forming apparatus 10, and the toner images to be transferred onto the sheet member P are the toner image formed by the toner image forming unit 30V and the toner image formed by the toner image forming unit 30Y which is superposed on part of the toner image formed by the toner image forming unit 30V.

Figure 2A:
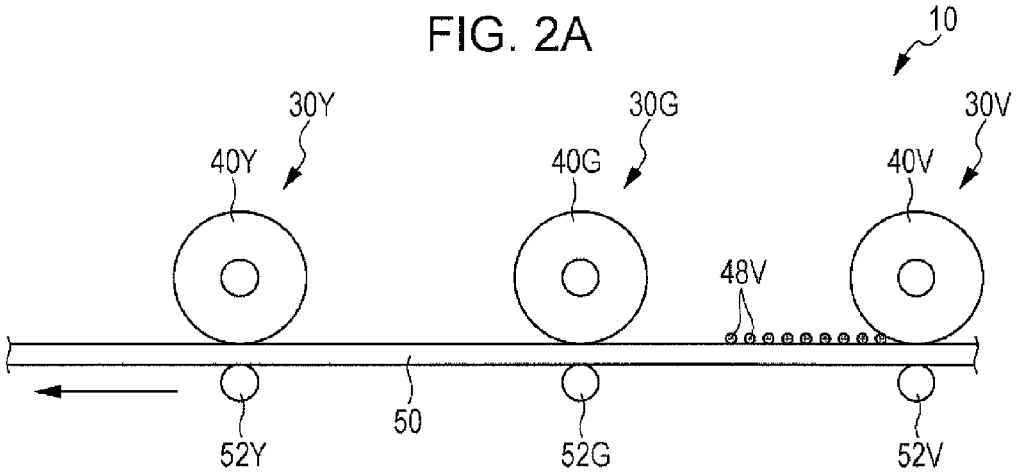
FIGS. 2A, 2B, and 2C illustrate steps in which toner images are transferred onto a sheet member with the image forming apparatus according to the first exemplary embodiment of the present invention.
Figure 2B:
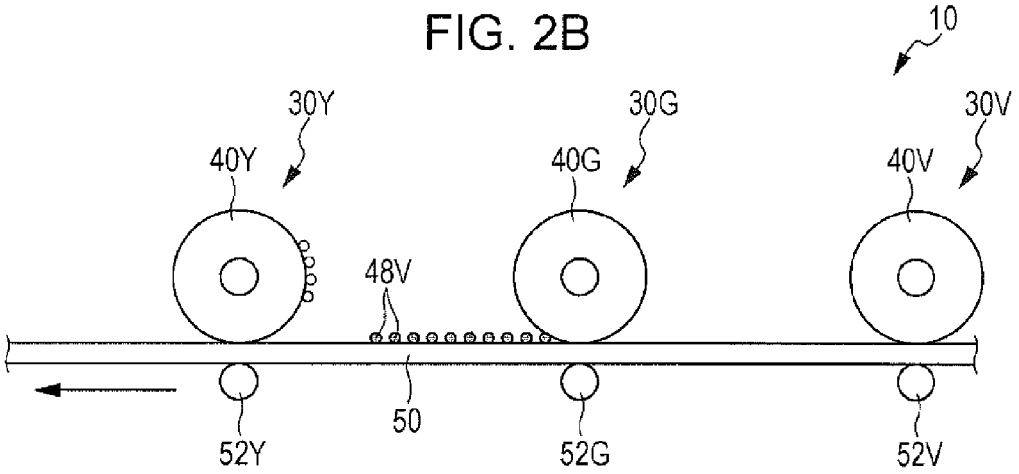

As illustrated in FIG. 2A, the toner image formed of the negatively charged violet (V) toner particles 48V is transferred onto the transfer belt 50 by the transfer current flowing from the first transfer roller 52V toward the image holding member 40V. Furthermore, the toner image formed of the toner particles 48V is transported by the transfer belt 50 being rotated. Then, as illustrated in FIG. 2B, the toner image formed of the toner particles 48V passes through the nip between the first transfer roller 52G and the image holding member 40G. In so doing, the charge amount of all the toner particles 48V is increased by the transfer current flowing from the first transfer roller 52G toward the image holding member 40G.

Figure 2C:
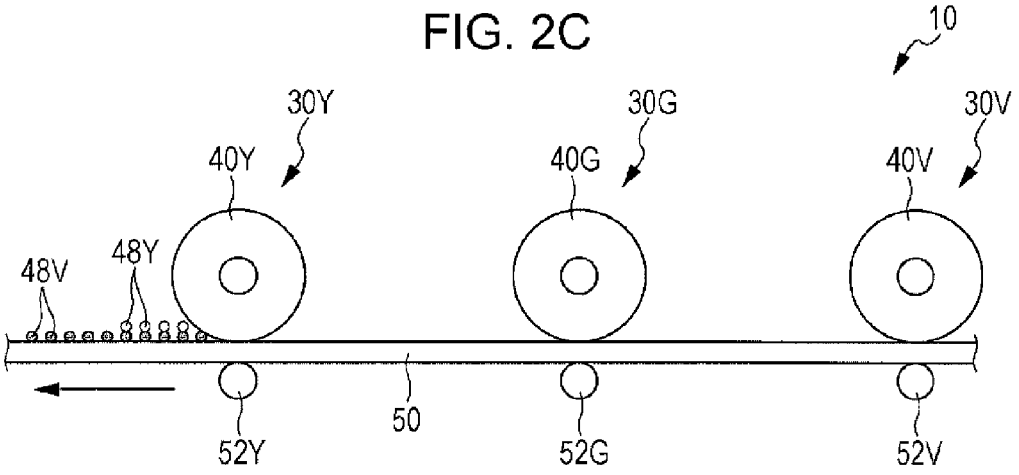

Furthermore, the toner image formed of the toner particles 48V is transported by the transfer belt 50 being rotated. Then, as illustrated in FIG. 2C, the toner image formed of the negatively charged yellow (Y) toner particles 48Y is transferred by the transfer current flowing from the first transfer roller 52Y toward the image holding member 40Y such that the toner image formed of the toner particles 48Y is superposed on part of the toner image formed of the violet (V) toner particles 48V. Thus, there are the violet (V) toner particles 48V on which the yellow (Y) toner particles 48Y are not superposed and the violet (V) toner particles 48V on which the yellow (Y) toner particles 48Y are superposed on the transfer belt 50.

Figure 3A:
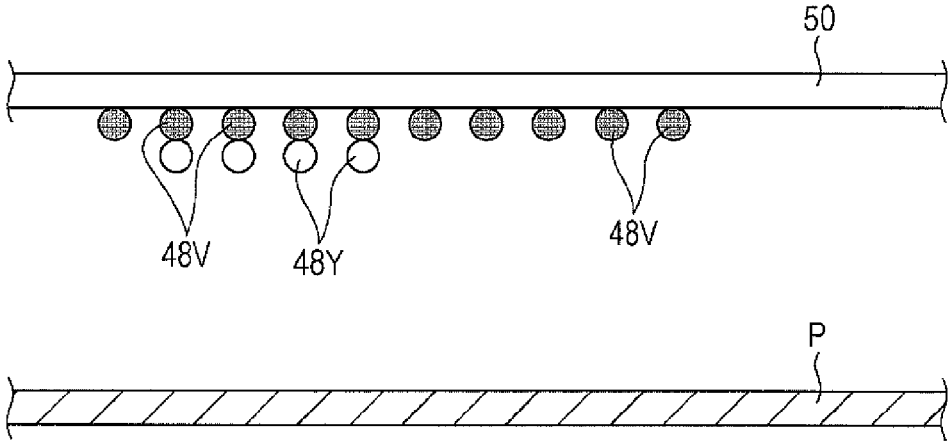
FIGS. 3A and 3B illustrate steps in which the toner images are transferred onto the sheet member with the image forming apparatus according to the first exemplary embodiment of the present invention.
Figure 3B:
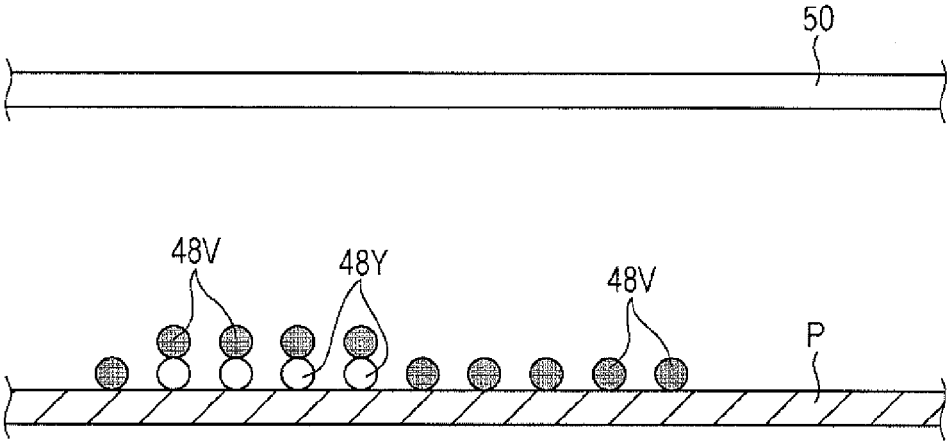

Furthermore, as illustrated in FIGS. 3A and 3B, by the transfer current flowing from the second transfer roller 54 to the roller 56, the toner images formed of the toner particles 48Y and the toner particles 48V on the transfer belt 50 are transferred onto the sheet member P being transported.

It is noted that FIG. 3A illustrates a state before the toner images are transferred onto the sheet member P, and FIG. 3B illustrates a state after the toner images have been transferred onto the sheet member P. Furthermore, the elements are schematically illustrated in FIGS. 3A and 3B so that the toner particles having been transferred onto the transfer belt 50 and the toner particles having been transferred onto the sheet member P are easily recognized.

The image forming apparatus 10 is different from the image forming apparatus 100 according to the comparative exemplary embodiment such that the toner image formed of the toner particles 48V passes through the nip between the first transfer roller 52G and the image holding member 40G. In so doing, the charge amount of all the toner particles 48V is increased by the transfer current flowing from the first transfer roller 52G toward the image holding member 40G. Thus, as illustrated in FIG. 3B, the toner particles 48V on which the toner particles 48Y are superposed are transferred onto the sheet member P, and the toner particles 48V do not remain on the transfer belt 50.

Thus, compared to an output image formed by the image forming apparatus 100 according to the comparative exemplary example, the occurrence of unevenness in an output image may be suppressed.

Second Example of the First Exemplary Embodiment

Next, the steps of transferring a toner image onto the sheet member P with the image forming apparatus 10 according to a second example of the first exemplary embodiment are described with reference to FIGS. 4A to 5B.

Toner images are formed only by the toner image forming units 30Y and 30G of the image forming apparatus 10, and the toner images to be transferred onto the sheet member P are the toner image formed by the toner image forming unit 30G and the toner image formed by the toner image forming unit 30Y which is superposed on part of the toner image formed by the toner image forming unit 30G.

Figure 4A:
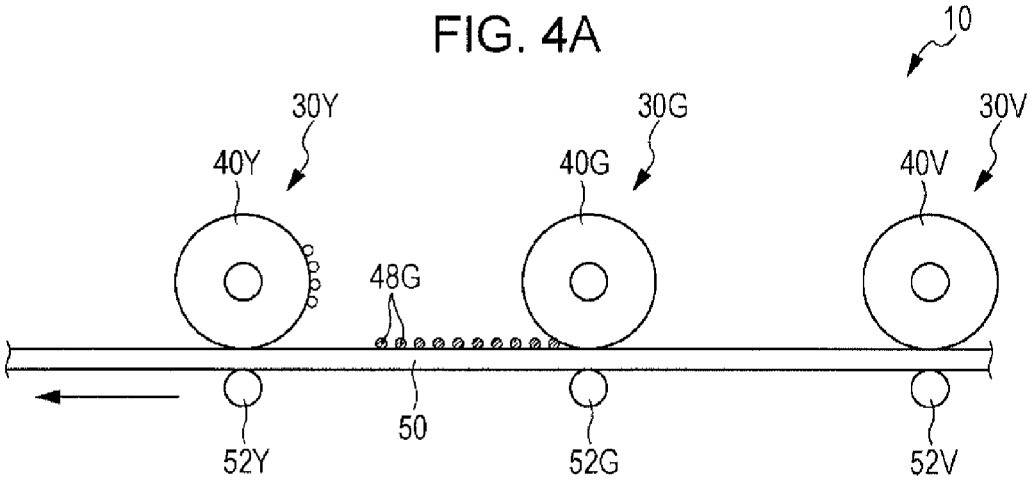
FIGS. 4A and 4B illustrate steps in which toner images are transferred onto the sheet member with the image forming apparatus according to the first exemplary embodiment of the present invention.
Figure 4B:
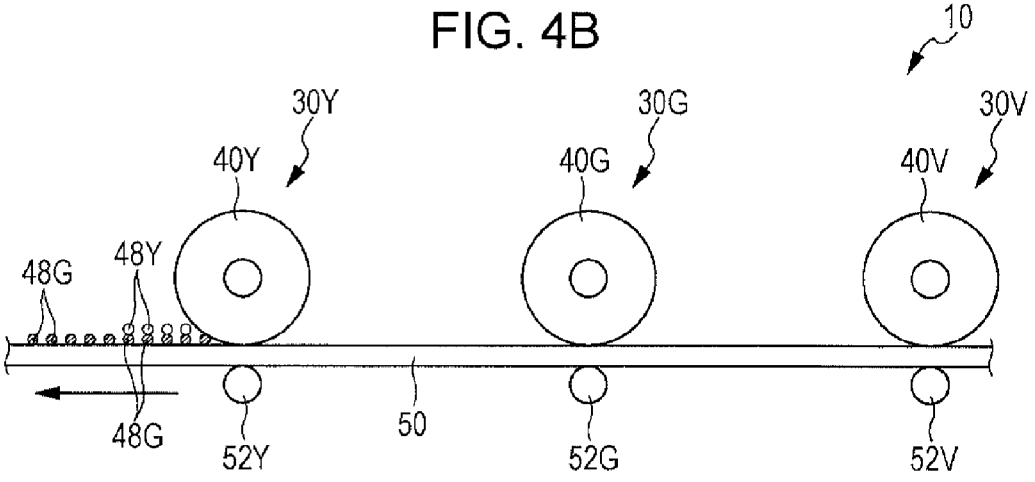

As illustrated in FIG. 4A, the toner image formed of negatively charged green (G) toner particles 48G is transferred onto the transfer belt 50 by the transfer current flowing from the first transfer roller 52G toward the image holding member 40G. Furthermore, the toner image formed of the toner particles 48G is transported by the transfer belt 50 being rotated. Then, as illustrated in FIG. 4B, the toner image formed of negatively charged yellow (Y) toner particles 48Y is transferred by the transfer current flowing from the first transfer roller 52Y toward the image holding member 40Y such that the toner image formed of the toner particles 48Y is superposed on part of the toner image formed of the green (G) toner particles 48G.

Thus, there are the green (G) toner particles 48G on which the yellow (Y) toner particles 48Y are not superposed and the green (G) toner particles 48G on which the yellow (Y) toner particles 48Y are superposed on the transfer belt 50.

In this state, when the green (G) toner image passes through the nip between the first transfer roller 52Y and the image holding member 40Y, an increase in the charge amount of the toner particles 48G on which the toner particles 48Y are not superposed is larger than an increase in the charge amount of the toner particles 48G on which the toner particles 48Y are superposed.

Figure 5A:
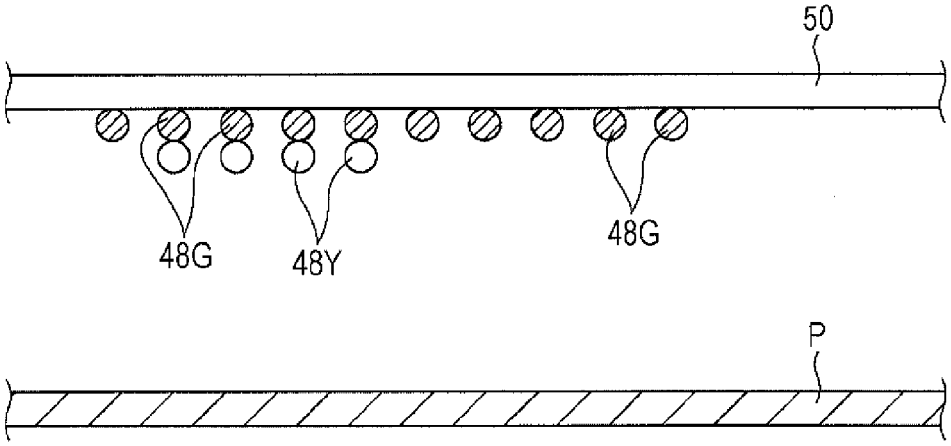
FIGS. 5A and 5B illustrate steps in which the toner images are transferred onto the sheet member with the image forming apparatus according to the first exemplary embodiment of the present invention.
Figure 5B:
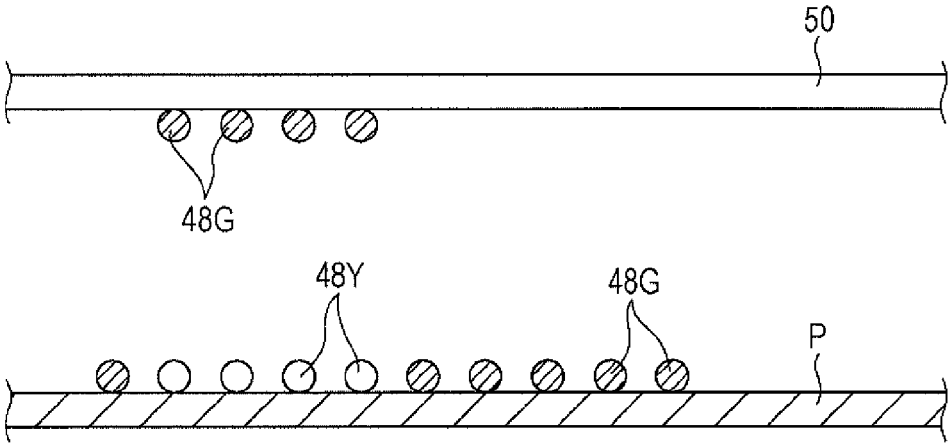

As illustrated in FIGS. 5A and 5B, by the transfer current flowing from the second transfer roller 54 toward the roller 56, the toner images formed of the toner particles 48Y and the toner particles 48G on the transfer belt 50 are transferred onto the sheet member P being transported.

It is noted that FIG. 5A illustrates a state before the toner images are transferred onto the sheet member P, and FIG. 5B illustrates a state after the toner images have been transferred onto the sheet member P. Furthermore, the elements are schematically illustrated in FIGS. 5A and 5B so that the toner particles having been transferred onto the transfer belt 50, the toner particles remaining on the transfer belt 50, and the toner particles having been transferred onto the sheet member P are easily recognized.

The toner particles 48Y are interposed between the sheet member P and the toner particles 48G on which the toner particles 48Y are superposed. Furthermore, the charge amount of the toner particles 48G on which the toner particles 48Y are superposed is smaller than that of the toner particles 48G on which the toner particles 48Y are not superposed. Thus, as illustrated in FIG. 5B, the toner particles 48G on which the toner particles 48Y are superposed remain on the transfer belt 50 instead of being transferred onto the sheet member P.

This may cause unevenness in an output image. However, unlike violet (V), green (G) is not a color of the lowest lightness with respect to yellow (Y). That is, the difference in lightness between the green (G) and yellow (Y) is smaller than the difference in lightness between violet (V) and yellow (Y). Thus, compared to the output image formed by the image forming apparatus 100 according to the comparative exemplary example, the likelihood of unevenness in an image becoming clearly visible may be reduced.

Summarization

As has been described, in the image forming apparatus 10, the first transfer roller 52G is disposed adjacent to the first transfer roller 52Y, and the first transfer roller 52V is disposed adjacent to the first transfer roller 52G. That is, the first transfer roller 52V, which transfers the image of the low-lightness color having the lowest lightness onto the transfer belt 50, is not disposed adjacent to the first transfer roller 52Y, which transfers the yellow (Y) toner image onto the transfer belt 50. This may suppress degradation of the quality of an output image caused by using a color of lightness that is lower than that of yellow (Y) (an example of a reference color of an image transferred by the first transfer unit disposed most upstream in the rotational direction).

Second Exemplary Embodiment

Next, an example of an image forming apparatus according to a second exemplary embodiment of the present invention will be described with reference to FIG. 11. The same elements as those in the first exemplary embodiment are denoted by the same reference signs and description thereof is omitted. The features of the second exemplary embodiment different from those of the first exemplary embodiment are described.

Figure 11:
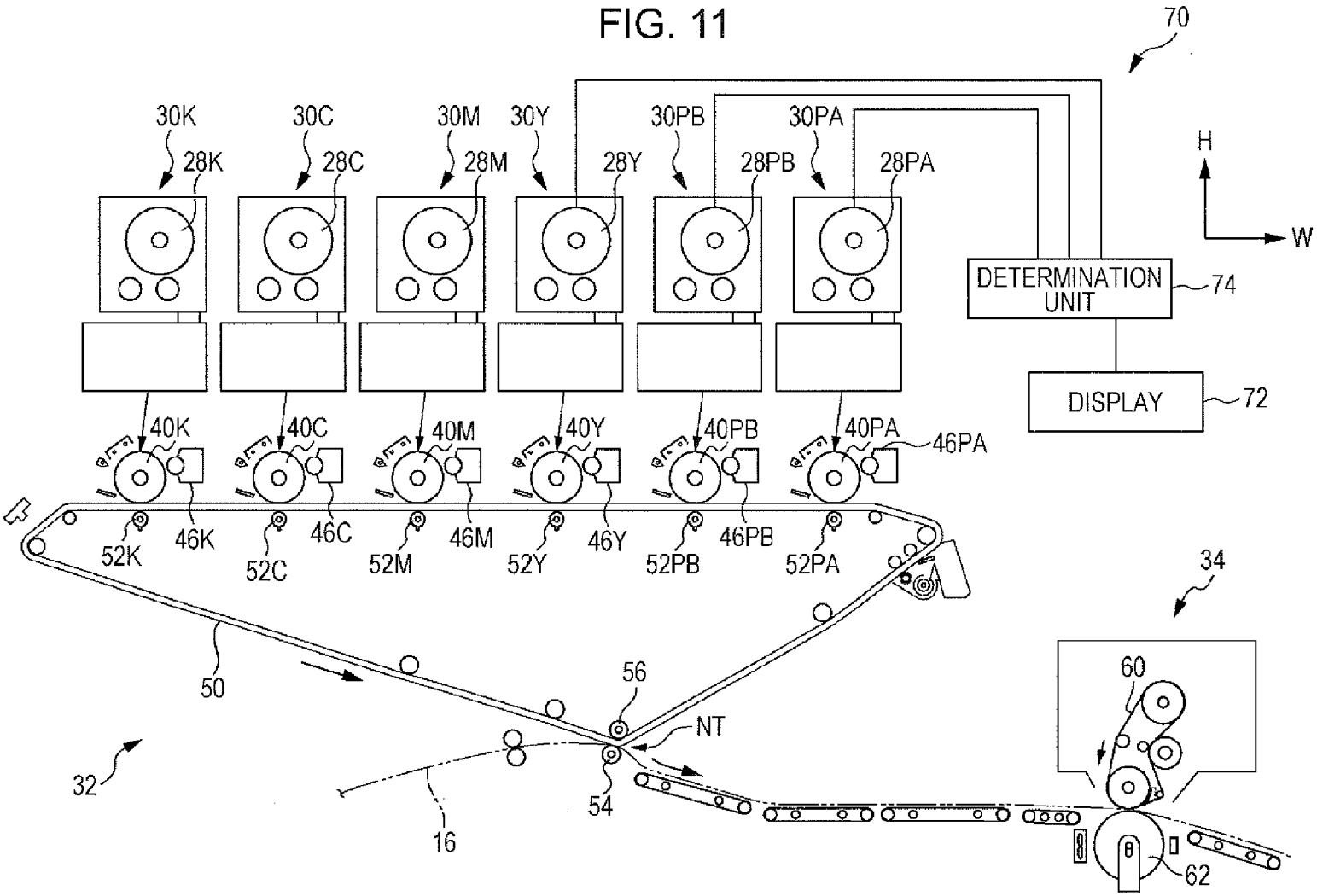
FIG. 11 is a view illustrating a structure of a transfer device and so forth of an image forming apparatus according to a second exemplary embodiment of the present invention.

As illustrated in FIG. 11, the toner image forming units 30 of a first special color (PA), a second special color (PB), yellow (Y), magenta (M), cyan (C), and black (K) are arranged in this order in an image forming apparatus 70 according to the second exemplary embodiment. Toner images of the first special color (PA), the second special color (PB), yellow (Y), magenta (M), cyan (C), and black (K) are transferred onto the transfer belt 50 through first transfer so as to be superposed on one another. That is, the first transfer rollers 52PA (an example of the second transfer unit), 52PB (an example of the second transfer unit), 52Y, 52M, 52C, and 52K are arranged in this order in the rotational direction of the transfer belt 50.

The image forming apparatus 70 includes a determination unit 74 that obtains lightness information of the first special color (PA), the second special color (PB), and yellow (Y) from the chips attached to the respective toner cartridges 28, thereby determining the difference in lightness between the first special color (PA) and yellow (Y) and the difference in lightness between the second special color (PB) and yellow (Y). The image forming apparatus 70 further includes a display 72 (an example of a warning member) that displays warning to the user in accordance with a result of determination performed by the determination unit 74.

Specifically, there may be a case where a single first transfer roller 52 of the first transfer rollers 52PA and 52PB transfers onto the transfer belt 50 an image of a color of lightness that is lower than that of yellow (Y), which is the reference color disposed most upstream in the rotational direction among the reference colors. In this case, the display 72 displays a warning when the first transfer roller 52 that transfers onto the transfer belt 50 the image of the low-lightness color out of the first special color (PA) and the second special color (PB), the lightness of the low-lightness color being lower than that of yellow (Y), is disposed adjacent to the first transfer roller 52Y. By this warning, the user is notified that unevenness in an image is highly likely to occur in the output image.

Furthermore, there may be a case where plural (two in the present exemplary embodiment) first transfer rollers 52 transfer onto the transfer belt 50 images of low-lightness colors out of the first special color (PA) and the second special color (PB), the lightnesses of the low-lightness colors being lower than that of yellow (Y), which is the reference color disposed most upstream in the rotational direction among the reference colors. In this case, the display 72 displays a warning when the first transfer roller 52 that transfers onto the transfer belt 50 the image of the low-lightness color having the lowest lightness color out of the first special color (PA) and the second special color (PB) is disposed adjacent to the first transfer roller 52Y. By this warning, the user is notified that unevenness in an image is highly likely to occur in the output image.

Thus, the user thinks of a change in the positional relationship between the toner cartridges 28. When the user changes the positional relationship between the toner cartridges 28, the occurrence of unevenness in an image may be suppressed in the output image.

Examples of variants of the above-described exemplary embodiments include, but not limited to, the following. For example, although the first transfer roller 52Y out of the first transfer rollers 52Y, 52M, 52C, and 52K is disposed on the most upstream side in the rotational direction of the transfer belt 50 in the above-described first and second exemplary embodiments, the first transfer roller 52M or 52C may instead be disposed on the most upstream side. In the case where the first transfer roller 52M is disposed on the most upstream side, magenta (M) is the reference color disposed most upstream in the rotational direction among the reference colors. In the case where the first transfer roller 52C is disposed on the most upstream side, cyan (C) is the reference color disposed most upstream in the rotational direction among the reference colors.

In the above-described first exemplary embodiment, in the rotational direction of the transfer belt 50, the lightnesses of both the colors of the toner images transferred by the first transfer rollers 52V and 52G, which are disposed upstream of the first transfer rollers 52Y, 52M, 52C, and 52K, are set to be lower than that of yellow (Y). However, the lightness of one of both the colors may be lower than that of yellow (Y). In this case, it is sufficient that the first transfer roller that transfers onto the transfer belt 50 the toner image of the color of lightness that is lower than the yellow (Y) not be disposed adjacent to the first transfer roller 52Y.

Although two special colors are provided in the above-described first and second exemplary embodiments, three or more special colors may be provided. In the case where three or more special colors including one low-lightness color are provided, it is sufficient that the first transfer roller 52 that transfers onto the transfer belt 50 one of the colors other than the low-lightness color be disposed adjacent to the first transfer roller 52Y. In the case where three or more special colors including plural low-lightness colors are provided, it is sufficient that the first transfer roller 52 that transfers onto the transfer belt 50 one of the colors other than the lowest-lightness color be disposed adjacent to the first transfer roller 52Y.

Furthermore, the special colors may be other colors such as, for example, orange and white.

Furthermore, although the warning to the user is performed by displaying the warning in the display 72 in the above-described second exemplary embodiment, the warning may be performed through another medium such as sound.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transfer member, onto which images of reference colors and images of a plurality of other colors are transferred while the transfer member is being rotated, the reference colors including yellow, magenta, cyan, and black, and the other colors being different from the reference colors;

a plurality of first transfer units that each transfer the image of a corresponding one of the reference colors;

a plurality of second transfer units that are disposed upstream of the first transfer units in a rotational direction of the transfer member and that each transfer onto the transfer member the image of a corresponding one of the plurality of other colors;

a determination unit that determines differences in lightness between a first reference color and each of the other colors, respectively, the first reference color being the reference color of the first transfer unit which is disposed most upstream in the rotational direction among the plurality of first transfer units, wherein the lightness of each color is obtained by measuring a single-color image patch formed on the sheet member; and a warning member that issues a warning based on the differences in lightness determined by the determination unit.

2. The image forming apparatus according to claim 1, wherein the determination unit determines, from among the plurality of the other colors, a color having a lowest lightness with respect to the first reference color, and wherein the warning member issues the warning when the color having the lowest lightness determined by the determination unit is disposed most downstream in the rotational direction among the plurality of second transfer units.

3. The image forming apparatus according to claim 1, wherein the determination unit determines, from among the plurality of the other colors, a color having a highest lightness with respect to the first reference color, and wherein the warning member issues the warning when the color having the highest lightness determined by the determination unit is not disposed most downstream in the rotational direction among the plurality of second transfer units.

4. The image forming apparatus according to claim 1, wherein the color of the first transfer unit which is disposed most upstream in the rotational direction is yellow.

5. The image forming apparatus according to claim 1, wherein the determination unit determines differences of lightness between the first transfer unit disposed most upstream and the second transfer unit disposed next to the first transfer unit disposed most upstream.

* * * * *